United States Patent [19]

Bello

[11] 4,445,579

[45] May 1, 1984

[54] PIPE CAROUSEL FOR WELL-DRILLING RIG

[76] Inventor: Paul Bello, 4756 Pullman St., Salem, Oreg. 97302

[21] Appl. No.: 291,669

[22] Filed: Aug. 10, 1981

[51] Int. Cl.[3] ..... E21B 19/14

[52] U.S. Cl. ..... 175/52; 175/85; 211/60 S; 211/1.5; 414/22

[58] Field of Search ..... 175/52, 85; 166/77.5, 166/85, 378–380; 211/60 S, 1.5, 60 R; 81/57.16, 57.17; 414/22

[56] References Cited

U.S. PATENT DOCUMENTS

| | | | |
|---|---|---|---|
| Re. 29,541 | 2/1978 | Russell | 175/52 |
| Re. 30,071 | 8/1979 | Hilding et al. | 175/52 |
| 3,025,918 | 3/1962 | Leven | 175/52 |
| 3,265,138 | 8/1966 | Alexander et al. | 175/52 |
| 3,913,753 | 10/1975 | Swartz et al. | 175/52 |
| 3,913,754 | 10/1975 | Swartz et al. | 175/52 |
| 3,966,053 | 6/1976 | Loftis | 211/60 S |
| 3,985,189 | 10/1976 | Jahnke et al. | 175/85 |
| 4,069,879 | 1/1978 | Brown et al. | 175/85 |
| 4,348,920 | 9/1982 | Boyadjieff | 166/77.5 |
| 4,357,843 | 11/1982 | Peck et al. | 81/57.16 |

*Primary Examiner*—Ernest R. Purser

*Assistant Examiner*—Hoang C. Dang

*Attorney, Agent, or Firm*—Klarquist, Sparkman, Campbell, Leigh & Whinston

[57] ABSTRACT

A drill pipe carousel comprises a circular pipe rack mounted for rotation about a vertical axis in a drilling mast, a rotational drive train and a push-pull mechanism for moving the rack to and from the drill string. The rack includes upper and lower support plates mounted on a hollow central support tube. The tube and plates are slotted on one side to provide an entry for the drill string into the center of the tube when the rack is moved toward the drill string. A pair of parallel flanges are mounted inside the tube in alignment with the entry for gripping the flattened gripping surfaces of the drill pipe. The rack rests on a large, slotted driven gear. The gear rotatably supported on a bearing plate connected to the push-pull mechanism. The tube is journaled in the bearing plate. A high torque, reversible hydraulic motor is mounted on the bearing plate. The motor is drivably connected to the driven gear through a train of drive gears arranged to bridge the slot as the rack is rotated. The rack has multiple storage slots arranged in either a radial or annular pattern around the central support tube.

13 Claims, 12 Drawing Figures

FIG. 6
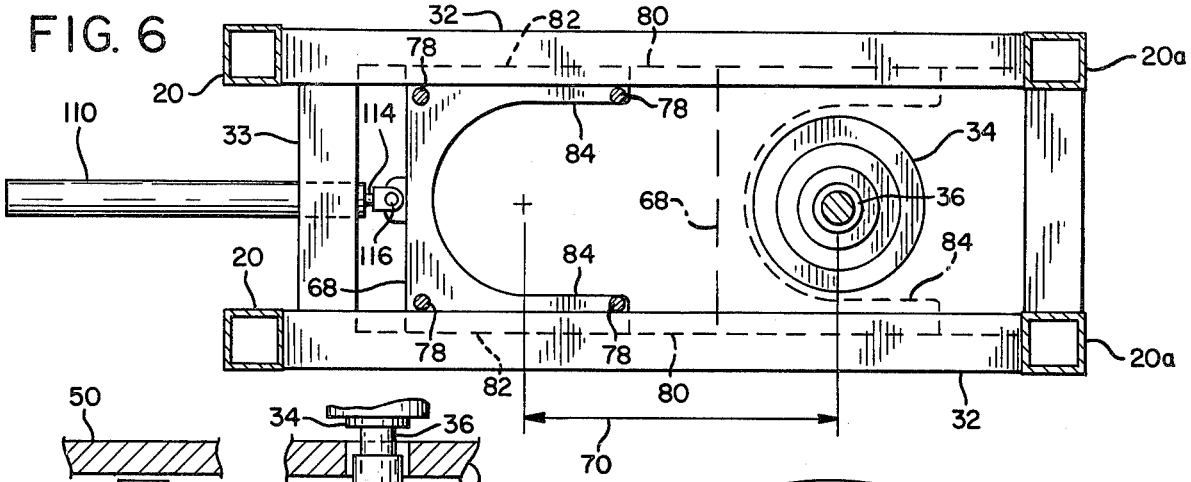
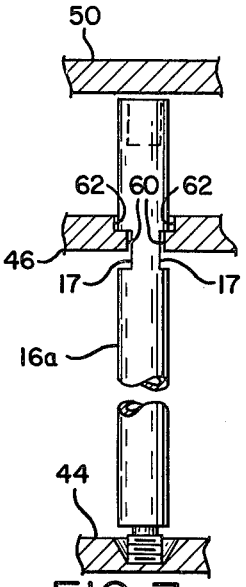
FIG. 7
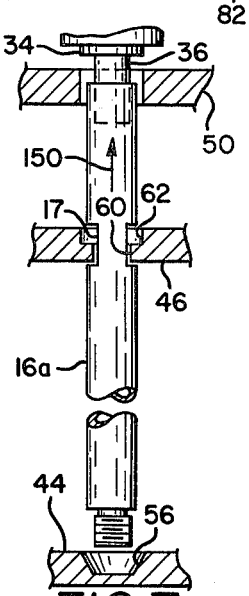
FIG. 7a
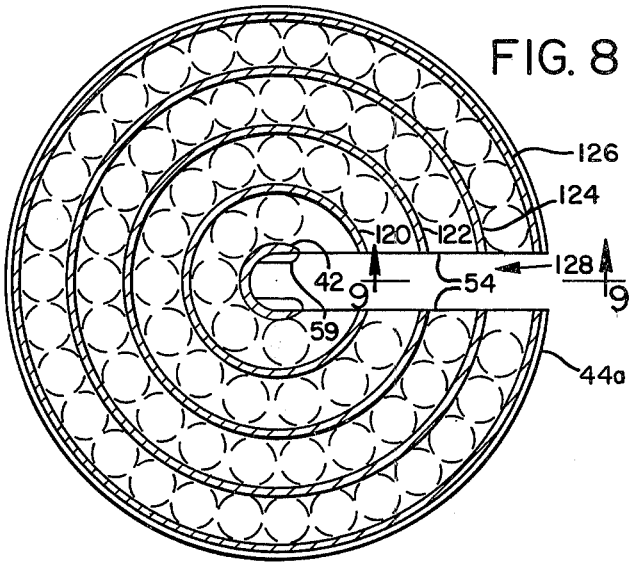
FIG. 8
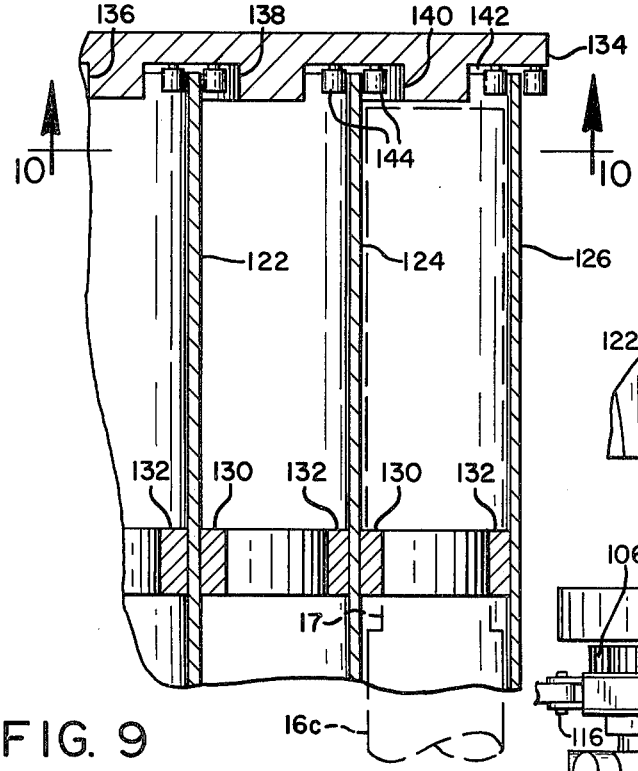
FIG. 9
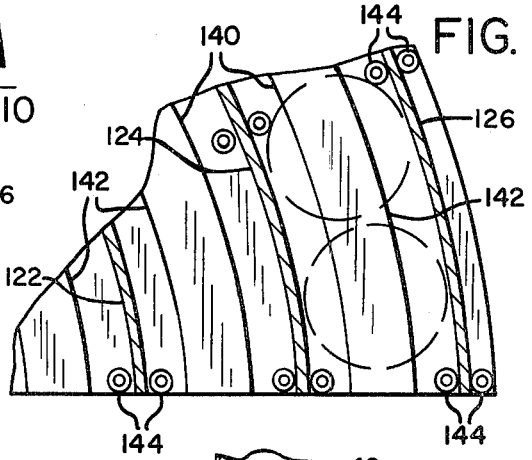
FIG. 10
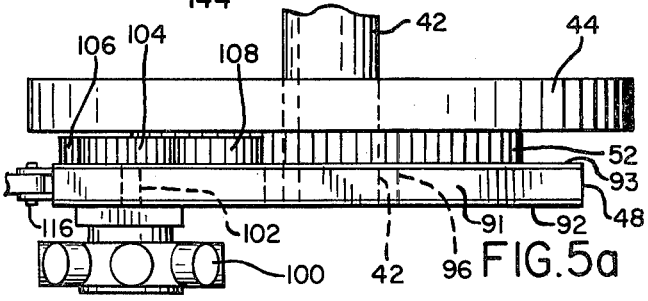
FIG. 5a

PIPE CAROUSEL FOR WELL-DRILLING RIG

BACKGROUND OF THE INVENTION

This invention relates generally to well-drilling apparatus and methods and more particularly to apparatus for storing drill pipe sections in the structure of a well-drilling rig for convenient addition to and removal from the drill string.

A conventional well-drilling rig includes an upright mast with a drill table at its lower end and a rotary drive mechanism or top head drive mounted for reciprocable vertical movement at its upper end. A drill string comprising multiple sections of drill pipe is suspended from top head drive by means of a threaded drill stem. The drill string extends downwardly from the drill stem into a bore hole through a guide in the drill table. Normally, a cutter head or drill bit is mounted on the end of the drill string in the bore hole.

In operation, the top head drive turns the drill stem which turns the drill string and bit mounted thereon to bore a hole in the earth. As the drill string penetrates into the earth, additional sections of drill pipe are added to the top of the drill string. This is done by first clamping the uppermost pipe in the drill string at the level of the drill table. The drill string is next disconnected from the top drive by unthreading the drill stem from the upper end of the uppermost drill pipe. The top head is then raised to an elevated position so that another section of drill pipe can be threaded at its upper end onto the drill stem and thereafter threaded at its lower end into the upper end of the top section of drill pipe in the drill string. This process continues until a desired depth has been reached, at which time the process is reversed to remove the drill string from the bore hole.

The entire string of drill pipe must be removed from the bore hole a section at a time whenever it is necessary to change a drill bit. This procedure, known as tripping a drill string, is a repetitive, tedious and time-consuming job. The drill string is raised from the bore hole a section at a time. Before removing the uppermost pipe section from the string, the next lower drill pipe must be clamped at the drill table to support the drill string in the bore hole and prevent its rotation when the uppermost section is unscrewed. Because of the torque exerted on the drill string by the top head drive during drilling, the threads between the pipe sections frequently become jammed together. When this happens, the uppermost section of the pipe cannot be unscrewed from the drill string solely by reversing the rotary drive mechanism. The drill stem merely unscrews from the top of the uppermost pipe. Accordingly, it is necessary for workmen to break the connection between the sections by means of a large manually- or hydraulically-operated wrench. This step slows the process of tripping the drill string and is also very dangerous.

Once the uppermost pipe is loosened from the drill string, the top head drive is driven in reverse to finish unthreading it. Next, the pipe must be removed from the top head drive. This step requires immobilizing the pipe against rotation either manually or by means of a suitable clamping device, adding further complexity and time; to the process. After the pipe is removed from the drill stem, it must be stored someplace until it is to be returned to the drill string.

In the past, many efforts have been made to provide racks and magazines located on or adjacent to the drilling mast to provide a convenient storage and handling mechanism for drill pipe sections. A conventional static pipe storage rack for storing pipe sections in parallel vertical rows is shown in U.S. Pat. No. Re. 29,541 of U.S. Pat. No. 3,949,818 to Russell. Such a storage rack eliminates the need for removing the drill sections from the mast during tripping of a drill string, but still necessitates considerable handling of the pipe sections and fails to alleviate the complexity of the tripping process itself.

To ease the problems in handling drill pipe sections stored in the mast, several types of movable and rotating racks or magazines have been devised. One such device is disclosed in U.S. Pat. No. 3,025,918 to Leven. Leven provides a rotary rack device for receiving a number of drill pipe sections in a circular pattern. The device is mounted within the drilling mast for rotation about a vertical shaft parallel to the drill string. It is pivotally connected to one side of the mast for swinging lateral movement toward and away from the drill string to add pipes to and remove pipes from the string. The rack includes a bottom turntable with sockets for receiving the lower ends of four pipe sections in a single ring. An upper means rotatable support member holds the upper ends of the sections in the rack. The sockets include means for preventing turning of the pipe sections in the sockets during attachment of the drill stem. Similar devices are disclosed in U.S. Pat. Nos. 3,913,753 and 3,913,754 to Swartz, et al. and in U.S. Pat. No. 3,966,053 to Loftis.

U.S. Pat. No. Re. 30,071 of U.S. Pat. No. 3,986,569 to Hilding, et al. discloses an arcuate rack which does not rotate, but swings laterally through a semicircular arc intersecting the center line of the drill string to place pipe sections in or remove them from an arcuate slot, and to store the pipes alongside the drill string. U.S. Pat. No. 3,265,138 to Alexander, et al. discloses a similar rack having two arcuate slots arranged around a common axis of oscillation.

Although the foregoing devices reduced the pipe-handling problems inherent in the static storage rack shown in the Russell patent, their storage capacity is quite limited. Moreover, these devices still do not significantly reduce the number of steps involved in removing each section of drill pipe from the drill string. Moreover, they do nothing to solve the problem of unsticking the threads of a pipe section from those of the rest of the drill string, when such threads are jammed.

Accordingly, there remains a need for an improved method of tripping a drill string. A need also remains for improved means for storing sections of drill pipe for convenient removal from and addition to the drill string.

SUMMARY OF THE INVENTION

It is therefore one object of the invention to improve the means for storage of pipe sections in a drilling rig.

A second object of the invention is to improve the process of tripping a drill string.

Another object of the invention is to enable the storage of substantially more pipe sections within a drilling mast than has previously been possible.

A further object of the invention is to enable unscrewing a top section of drill pipe from a drill string without inadvertently disconnecting such section from the drill stem on the top head drive.

Yet another object is to enable unjamming of threads between a top section of drill pipe and the rest of the drill string without interrupting the tripping process.

These objects are achieved by a pipe carousel with a central support tube having an opening extending along one side to receive and hold an upper section of drill pipe in a drill string. The tube is mounted for rotation about a vertical axis at the center of the carousel. Rotating means rotate the tube along with the rest of the carousel to unscrew the pipe section from the drill string. The carousel includes means for moving the central support tube laterally to and from a position concentric with the drill string. The central support tube has an entry means or vertical slot in one side for admitting the pipe section as the carousel is moved laterally toward the pipe section. The central support tube includes means for securing the pipe section against rotation inside the tube.

The carousel preferably includes pipe rack means rotatable with the central support tube about a common axis for storing multiple sections of pipe. The rack means has a radial entry means or slot aligned with the vertical slot in the central support tube. In one embodiment, multiple pipe sections are stored in other generally radial storage slots accessible from the periphery of the rack means. In another embodiment, the pipe sections are stored in annular storage slots accessible from the radial entry means between the central support means and the periphery of the rack means. The storage slots include means for securing the pipe sections against rotation therein. At least five pipe sections can be stored in an innermost ring around the central support means. A second ring will hold at least 11 sections. Further rings of pipe sections can be provided. In contrast, the prior art only allows use of one ring of sections.

The invention also contemplates a method of tripping a drill string including positioning the central support means coaxially about the pipe section to be removed, securing the pipe section therein and rotating the central support means to unscrew the section while holding the rest of drill string below the carousel so that it will not rotate. The top head drive need not be driven to unscrew the top section of pipe from the drill string. Hence, the risk of unscrewing the drill stem from the section's upper end is avoided. Once the top pipe section is unscrewed from the drill string, the carousel can be moved laterally and rotated to position such section in a storage slot in the pipe rack. The section is secured against rotation in the storage slot so that the drill stem can be unscrewed from its upper end. The top head drive can then be reconnected to the drill string for pulling it up until another section of pipe is exposed and then repeating the foregoing steps.

The foregoing and other objects, features and advantages of the invention will become more apparent from the following detailed description of a preferred embodiment of the invention, which proceeds with reference to the accompanying drawings.

BRIEF DESCRIPTION OF THE DRAWINGS

FIG. 5 is a cross-sectional view taken along line 5—5 in FIG. 1 showing the bottom bearing plate and rotational drive mechanism of the pipe carousel in top plan view.

FIG. 5*a* is an enlarged side elevational view of the base plate, bottom bearing plate and rotational drive mechanism of the carousel of FIG. 1.

FIG. 6 is a cross-sectional view taken along line 6—6 in FIG. 1 showing the top support structure of the carousel and the mechanism for moving the carousel laterally to envelop a top section of pipe in the drill string, as shown in phantom lines.

FIGS. 7 and 7*a* are transverse sectional views taken along line 7—7 in FIG. 1, showing a section of pipe positioned in a storage slot in FIG. 7 and during removal therefrom in FIG. 7*a*.

FIG. 8 is a cross-sectional view of an alternative embodiment of a pipe rack built in accordance with the invention but having annular storage slots, four rings of pipe sections being shown in phantom lines in the slots.

FIG. 9 is an enlarged transverse sectional view taken along line 9—9 in FIG. 8 showing an alternate embodiment of the top bearing plate.

FIG. 10 is a cross-sectional view taken along line 10—10 in FIG. 9 showing a portion of the top bearing plate in a bottom plan view.

DETAILED DESCRIPTION OF A PREFERRED EMBODIMENT

Overall Arrangement

Figure 1:
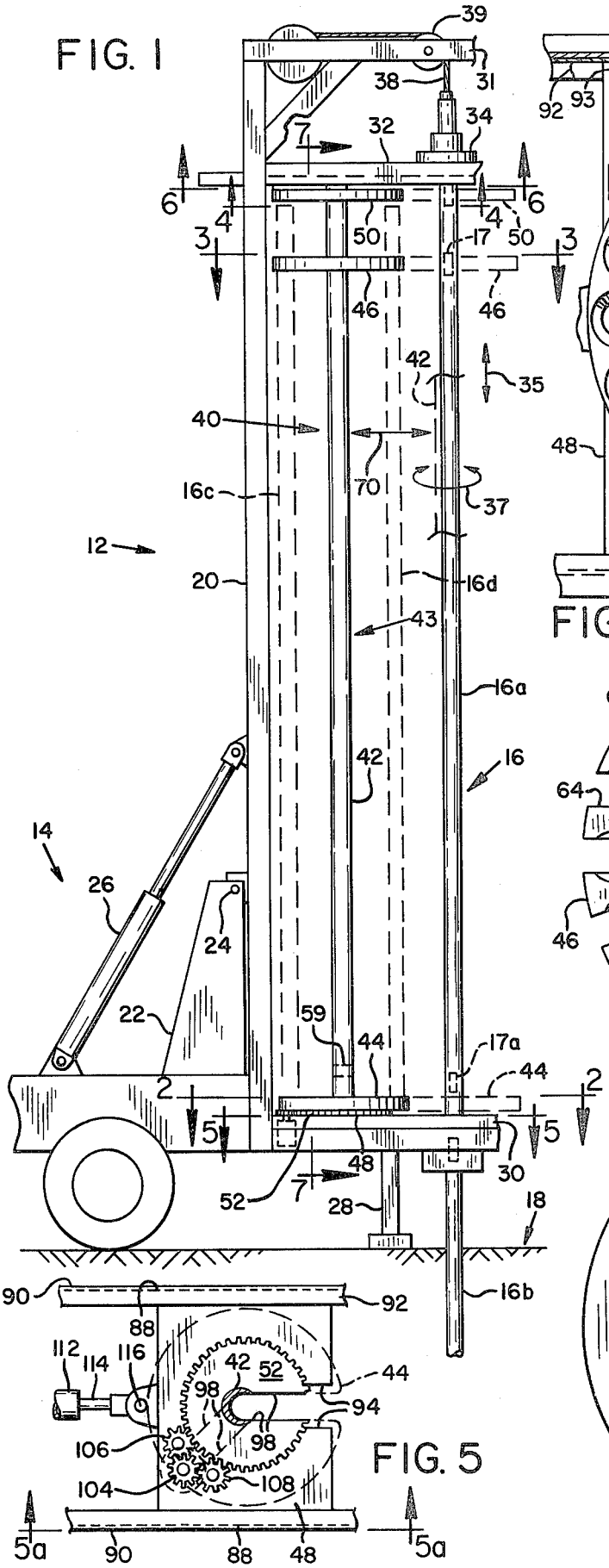
FIG. 1 is a side elevational view of a portable well-drilling rig including a pipe carousel in accordance with the invention positioned within the framework of the mast of the rig, the mast and pipe carousel being shown in upright position for drilling, two pipes being shown in the carousel in phantom lines, portions of the mast being cut away for clarity.

Referring to FIG. 1, a portable well-drilling mast 12 is shown in an upright position mounted on the tail end of a trailer 14. The mast supports a drill string 16 made up of sections of drill pipe 16*a*, 16*b* extending downwardly into a bore hole in the ground 18. Each section of drill pipe is internally threaded at its upper end and externally threaded in complementary fashion at its lower end. Just below its upper end, each section of drill pipe is indented along opposite sides to provide flat, parallel gripping surfaces 17. Similar surfaces 17*a* are provided just above the lower end of each section. A conventional drill bit or cutter head (not shown) is mounted at the base of the drill string at the bottom of the bore hole.

The drilling mast 12 is a generally rectilinear structure comprising, for example, two pairs of parallel upright members, 20, 20*a* arranged in a rectangular pattern, as shown in FIG. 6. Members 20 are pivotally connected to a mounting structure 22 on the trailer by means of pivot bolts 24. A hoist 26 is connected to the mast above the pivot bolts and to the bed of the trailer forwardly of the mounting structure for tilting the mast into a horizontal travel position. The mast includes a pair of adjustable legs 28 for leveling the mast in its vertical position for drilling.

At the base of the drilling mast is a conventional drill table 30. The drill table includes a conventional clamping device (not shown) for clamping the drill string so that the drill string will neither rotate nor drop into the bore hole when drill pipe sections are being removed from or added to it. At the top of the drilling mast are a pair of parallel top support beams 31 extending horizontally between the pairs of upright members 20, 20*a*. A second pair of support beams 32, spaced below beams 31, also extend horizontally between the pairs of upright members and are interconnected by cross beams 33, as shown in FIG. 6.

A reversible rotary drive mechanism or top head drive 34 is supported for reciprocable vertical movement, as indicated by arrow 35, by a cable 38 and pulley 39 mounted between beams 31. Protruding downwardly from the top head drive is a drill stem 36, best seen in FIG. 7*a*. The drill stem is externally threaded for screwing into the top end of the uppermost section of drill pipe for rotating the drill string, as indicated by arrow 37 in FIG. 1.

A pipe carousel 40 in accordance with the invention is mounted inside the mast between upright members 20 and the drill string 16 for conveniently storing additional pipe sections 16*c*, 16*d*. The pipe carousel is supported at its upper end by beams 32 and at its lower end by the drill table 30, as described in further detail hereinafter.

General Structure of Pipe Carousel

The pipe carousel includes a pipe rack comprising a central support tube 42 extending lengthwise, parallel to mast uprights 20, from the base of the mast to support beams 32. The support tube has an opening 43 on one side extending along the tube's entire length to provide an entry means for the drill string. The pipe rack also includes a bottom rack plate 44 spaced a short distance above the bottom end of tube 42 and a top rack plate 46 spaced a somewhat greater distance below the top end of tube 42. The two rack plates are secured to the tube to rotate therewith.

The pipe rack is supported by support means comprising a bottom bearing plate 48 and a top bearing plate 50. Sandwiched between the bottom rack plate and bottom bearing plate is a large driven gear 52, forming part of the rotating means of the carousel, as further described hereinafter. The bottom rack plate and driven gear have smooth, greased interfacing surfaces so that the rack can turn freely thereon.

Figure 2:
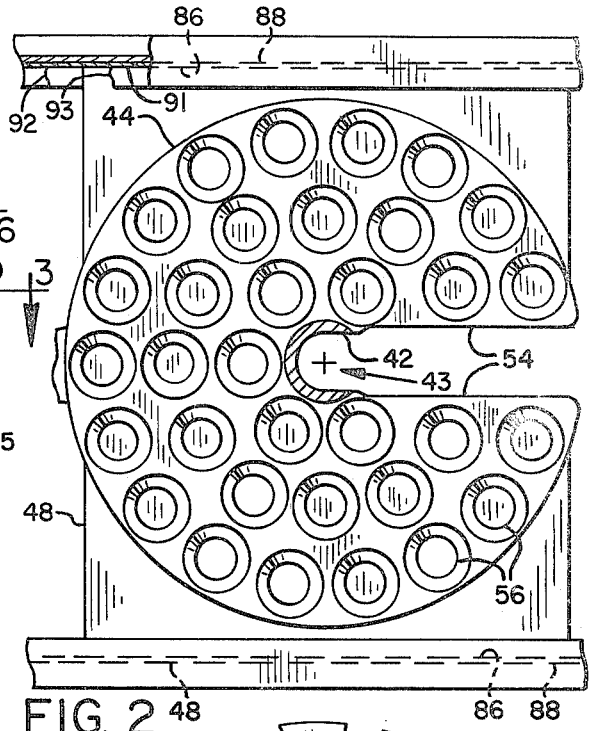
FIG. 2 is a cross-sectional view taken along line 2—2 in FIG. 1 showing a portion of the drill table and the base plate of the pipe rack of the pipe carousel in top plan view, a portion of the drill table being broken away to show interior detail.

Referring to FIG. 2, the bottom rack plate is a circular member concentric with tube 42. Plate 44 has a radial slot 54 extending outwardly from the opening 43 in the central support tube to the periphery of the plate. The upper surface of the bottom rack plate is provided with frustoconical indentations or cups 56 arranged in three annular rings concentric with tube 42 for receiving the lower, externally-threaded ends of up to 33 sections of drill pipe in the example shown. The manner in which the sections of pipe are seated in the indentations is best seen in FIG. 7.

Figure 3:
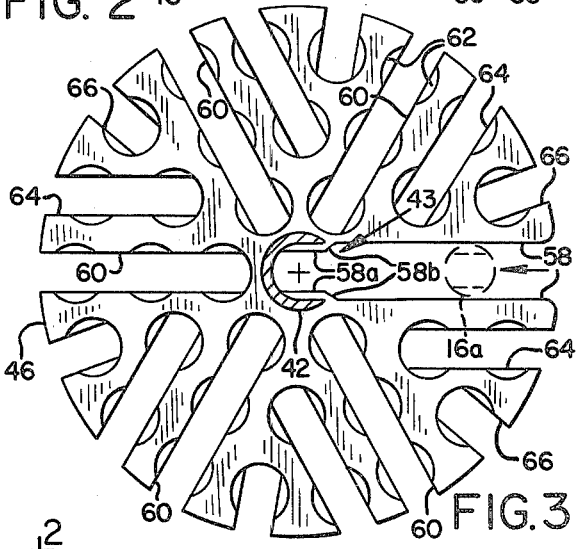
FIG. 3 is a cross-sectional view taken along line 3—3 in FIG. 1 showing the top rack plate of the pipe rack in top plan view, a section of drill pipe being shown in phantom lines in the radial entry slot of the plate.

Referring to FIG. 3, the top rack plate 46 is likewise a circular member concentric with tube 42. The top rack plate has a radial slot 58 extending parallel to slot 54 outwardly from the opening 43 in the central support tube to the periphery of the plate. The radially outermost portion of the slot 58 is wide enough to receive full diameter of a drill pipe. Its radially inner portion extends inside tube 42 through opening 43 and is constricted to define support flanges 58*a* for supporting a section in the tube. The sides of the flanges are spaced apart to conform to the flat indented side faces 17 of the drill pipe sections. The flanges have beveled shoulders 58*b* providing a smooth transition from the outermost portion of the slot into the tube. A second pair of support flanges 59 similar; to flanges 58*a* are shown in FIG. 1 mounted inside tube 42 in a lower position to engage the lower gripping surfaces 17*a* of the drill pipe.

The top rack plate has five radial storage slots 60 radiating outwardly in a hexagonal pattern concentric with tube 42 from positions spaced radially outwardly a short distance from the tube to the periphery of the plate. The sides of slot 60 are parallel and spaced just far enough apart to receive the flat portions 17 of the drill pipe sections between them. At the radially innermost end of each of slots 60 and at intervals therealong, the slot is countersunk along the upper side of the plate to provide circular indentations or cups 62 for receiving a circular portion of a drill pipe section just above its flat side faces 17. The indentations 62 on the top rack plate are vertically aligned with the indentations 56 on the bottom rack plate. In the embodiment shown, each of the radial slots 60 is provided with indentations for supporting three sections of drill pipe. This number can be varied as desired, depending on the respective dimensions of the pipe and the plate. Besides radial slots 58, 60, the top plate is provided with six non-radial storage slots 64 sized to hold two pipe sections and six radial storage slots 66 sized for supporting a single pipe section. In all other respects, slots 64, 66 are identical to slots 60.

Figure 4:
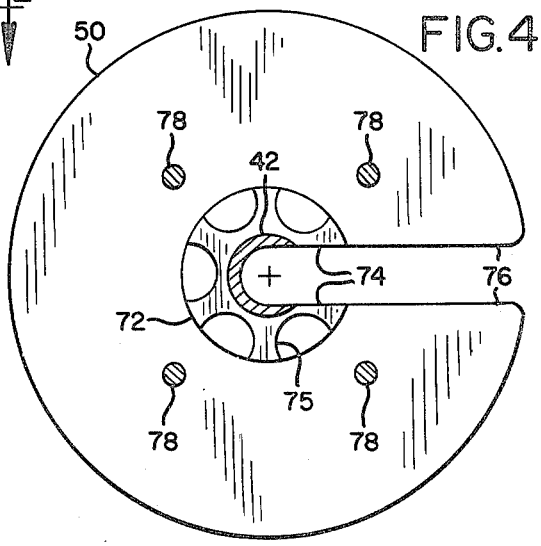
FIG. 4 is a transverse cross-sectional view taken along line 4—4 of FIG. 1 showing the top bearing plate of the pipe carousel in top plan view.

Referring to FIGS. 4 and 6, the top bearing plate 50 is mounted on the underside of a carriage 68 which is, in turn, mounted for reciprocable horizontal movement between beams 32, as indicated by arrow 70. Bearing plate 50 is an annular member having a large radius bearing 72 supporting the upper end of central support tube 42 concentrically therein. The bearing is secured to the tube and has a radial slot 74 extending outwardly from the opening 43 in the side of the tube to the periphery of the bearing. The bearing plate likewise has a radial slot 76 extending from its inner radius to its outer periphery. Slots 74, 76 are sized to admit a section of drill pipe into the central support tube when radially aligned as shown in FIG. 4. The bearing 72 also has five semicircular openings 75 arranged hexagonally around its periphery in vertical alignment with the radially innermost cups 56, 62 of rack plates 46, 48. The bearing plate is rigidly secured to the carriage 68 by means of four bolts 78.

Carriage 68 is a generally U-shaped member having flat parallel opposite sides 82, received in parallel inwardly opposed channels 80 in beams 32. The sides of the channels are provided with low friction surfaces, such as strips of ultra high molecular weight (UHMW) plastic to enable easy sliding movement of the carriage along the channels. Low friction sliding surfaces are provided for the lower bearing plate in the same way as described and shown in greater detail in Fig. 2. The inner sides 84 of the U-shaped carriage are spaced far enough apart to enable positioning of the carriage around the top head drive 34, as shown in phantom lines in FIG. 6. Bearing plate 50 is positioned below the carriage with slot 76 centered between sides 84 so as to receive the drill stem and upper end of the top section of drill pipe in the upper end of tube 42 when the carriage is positioned around the top head drive, as shown in phantom lines in FIG. 1.

Referring to FIG. 2, the bottom bearing plate 48 incorporates features of both the top bearing plate 50 and carriage 68. It is generally rectangular with opposite sides 86 spaced apart to just fit inside inwardly-opposed parallel channels 88 extending along inner side frame members 90 of drill table 30. Strips 91, 92, 93 of ultra high molecular weight density (UHMW) plastic extend along the bottom and sides of each channel 88 to provide low frictional sliding surfaces for the end faces and upper and lower margins of sides 86. The strips may alternatively be mounted on the bottom bearing plate, as shown in FIG. 5*a*.

Referring to FIG. 5, the bottom bearing plate has a slot 94 extending parallel to sides 86 from the outer periphery of the bearing plate to the end of the bearing plate adjacent the drill string. Journaled in the bottom bearing plate is an annular bearing (not shown) in which the lower end of tube 42 is received, bearing has a radial slot like slot 74 in upper bearing 72. As mentioned above, the bottom bearing plate supports substantially all of the weight of the pipe rack. It also supports rotating means for rotating the pipe rack.

Referring to FIGS. 5 and 5*a*, the rotating means includes the aforementioned driven gear 52 sandwiched between rack plate 44 and bearing plate 48, and a high-torque, low-speed (e.g. 0–400 r.p.m.) reversible hydraulic drive motor 100 mounted on the underside of bearing plate 48. The motor's output shaft 102 extends vertically through support plate 48 to a main drive gear 104 atop the bearing plate. The main drive gear 104 drives a pair of secondary drive gears 106, 108 which, in turn, drive the driven gear. The motor is connected to a conventional hydraulic fluid pressure circuit (not shown) operable to selectably reverse the direction of rotation of the motor and shaft 102 and, hence, the direction of rotation of pipe rack 40.

Like the bottom rack plate, the driven gear has a radial slot 98 extending outwardly from the opening 43 in tube 42 to the periphery of the driven gear. The secondary drive gears are journaled for rotation in the bottom bearing plate at positions angularly spaced apart about the axis of rotation of tube 42 a distance such that one of the gears is always meshed with the gear teeth of driven gear 52 when slot 98 is rotated beneath the other secondary gear. The drive gears and driven gears are proportioned to provide a gear reduction of, for example, 4 to 1 between the main drive gear and the driven gear, to multiply the high torque produced by the motor at very low speed for unscrewing pipe sections with jammed threads.

Referring to FIGS. 5 and 6, a moving means is connected to carriage 68 and bottom plate 48 for moving the pipe carousel laterally between a position apart from the drill string and a position enveloping the drill string, as shown in phantom lines in FIGS. 1 and 6. The moving means includes a pair of hydraulic rams 110, 112 supported by the structure of the mast, such as by cross beam 33 at the upper end of the mast. The rams have push rods 114 which are connected by means of vertical pintle bolts 116 to the carriage and bottom bearing plate, respectively. The hydraulic rams are connected to a hydraulic fluid circuit (not shown) for simultaneously extending or retracting the push rods to move the pipe carousel laterally as indicated by arrow 70 in FIG. 6.

Alternate Embodiment of Pipe Rack

Referring to FIG. 8, an alternative form of pipe rack in accordance with the invention comprises a series of radially-spaced apart semicircular walls 120, 122, 124, 126 positioned concentrically about tube 42. The open sides of the walls are aligned radially with slot 54 in base plate 44*a* and with the opening 43 in the side of the tube 42 to form, in effect, a radial entry means or slot 128 extending outwardly from such tube to the periphery of the rack. The semicircular walls are secured to the base plate and free at their upper ends. They are spaced apart a distance sufficient to receive pipe sections between them.

Referring to FIG. 9, semicircular annular support flanges 130, 132 extend horizontally along each side of each of the semicircular walls. The flanges on adjacent walls protrude inwardly into the space between such walls in vertical position to engage the gripping surfaces 17 of the pipe sections. This embodiment of pipe rack employs a top bearing plate 134 which is generally similar to plate 50. However, on its underside, plate 134 has annular channels 136, 138, 140 and 142 for receiving the free upper ends of the walls 120, 122, 124, 126, respectively. Spaced radially along each of these channels are pairs of roller bearings 144 mounted for rotation on vertical axes and positioned on opposite sides of each of the walls.

Operation

Returning to FIG. 1, the first step in tripping a drill string is to raise the top head drive 34 to a height sufficient to expose a top section of drill pipe 16*a* above the drill table 30. The top head drive is operated to rotate gripping surfaces 17, 17*a* into alignment with the direction of movement of the pipe rack. The pipe rack is then rotated, by operation of motor 100, to align the radial slots 54, 58, 98 in the top and bottom rack plates and the driven gear, and the tube opening 43, with the drill string. Next, the hydraulic rams 110, 112 are extended to move the pipe rack laterally, as indicated by arrow 70, to envelop the drill pipe in the rack and, more particularly, to admit the drill pipe section 16*a* through opening 43 in tube 42, as shown in phantom lines in FIGS. 1 and 6. The support flanges 58*a*, 59 in the tube 42 engage the flat gripping surfaces 17, 17*a*, at the upper and lower ends of pipe section 16*a*, respectively. Next, with the drill string supported by conventional clamping means in the drill table, motor 100 is operated to rotate the pipe rack to unscrew pipe section 16*a* from the next lower pipe section 16*b*. If the threads between sections 16*a* and 16*b* are jammed, the motor and gears provide sufficient torque to unjam them. Thereafter, the pipe rack is continued to be rotated until the sections are disconnected. Meanwhile, the top head drive is allowed to turn freely with section 16*a*, its drill stem remaining connected thereto.

Once section 16*a* is disconnected from the drill string, rams 110, 112 are retracted to move the pipe rack away from the drill string, leaving pipe section 16*a* hanging from the top head drive. Once the pipe rack is clear of the pipe section, motor 100 is operated to rotate the rack to bring one of storage slots 60, 64, 66 into approximate alignment with such section. The rams 110, 112 are then extended to move the pipe rack toward the drill string to position the pipe in the selected storage slot 60, as shown in FIG. 7*a*. The top head drive is then operated to unscrew the drill stem from the top of the pipe section, allowing the section to drop a short distance into cups 56, 62 in the bottom and top rack plates 44, 46, respectively.

The pipe rack is then moved away from the drill string and rotated to once again position slots 54, 58, 98 in alignment with the drill string. Pipe section 16*a* remains securely held in the pipe rack by plates 44, 46 and 50, as shown in Fig. 7. The top head drive is then lowered, operated to thread the drill stem into the top end of pipe section 16*b*, and raised to elevate the drill string and expose pipe 16*b*. The foregoing process is then repeated.

To lengthen a drill string in its bore hole, the upper end of the uppermost pipe section in the drill string is clamped at drill table 30 and the top head drive is operated to unscrew the drill stem. The top head drive is then raised. Motor 100 is operated to rotate the pipe rack to align a storage slot containing a section of drill pipe with the drill string. The rams 110, 112 are then extended to move the pipe rack toward the drill string until the stored pipe is positioned beneath the drill stem of the top head drive. The top head drive is then lowered and operated to thread the drill stem into the stored pipe section. The pipe section is then raised, as indicated by arrow 150 in FIG. *7a*, to remove it from cups 56, 62. The rams are then retracted to move the pipe rack away from the drill string, leaving the pipe suspended from the top head drive. The top head drive is then lowered and operated to screw the lower end of the drill pipe into the top of the drill string. The drill string is then unclamped at the drill table to continue drilling. When the drill string has descended for the entire length of the uppermost section of drill pipe, the foregoing process is repeated.

The pipe carousel can also be used to store pipe sections in the drilling mast while in transit. When the drilling rig is to be moved, the mast is rotated forwardly about pivot 24 to lie horizontally along the length of trailer 14. While the pipe rack is in a horizontal position, bearing plate 50 and bottom rack plate 44 prevent lengthwise movement of the pipe sections and thus retain them in their respective slots.

In operation, a pipe carousel incorporating the pipe rack of FIGS. 8–10 is quite similar to that of the rack of FIGS. 1–4. The primary difference is that, when the section of drill pipe has been unscrewed using the central support tube and it is desired to place that pipe into a storage slot, the pipe rack need only be moved laterally a distance sufficient to position the pipe section radially along slot 128 at the mouth of one of the annular storage slots. Then, the pipe rack is rotated to position the section within the selected storage slot.

Having illustrated and described two alternative embodiments of the invention and the operation thereof, it should be apparent to those skilled in the art that the invention may be modified in arrangement and detail without departing from the invention. I claim as my invention all such modifications as come within the spirit and scope of the following claims.

I claim:

1. A well-drilling pipe carousel comprising:

a hollow central support tube having an opening extending lengthwise along one side thereof so as to provide the tube with a C-shaped cross section, the tube and opening being sized so that a section of drill pipe can be positioned in the tube;

support means for supporting the tube in a well-drilling mast for rotation about a vertical axis;

moving means for moving the support means and tube laterally relative to the drilling mast to envelop the uppermost pipe section of a drill string in nesting, substantially concentric relationship, the tube being rotationally positioned so as to admit the pipe section laterally through said opening;

pipe engaging means for engaging the pipe section against rotation inside the tube, and rotating means connected to the support means for rotating the tube about said vertical axis to unscrew said section from the drill string.

2. A pipe carousel according to claim 1 including a pipe storage means surrounding the central support tube for storing multiple sections of drill pipe around said tube, the pipe storage means including means defining a radial slot aligned with the opening in the tube and extending radially outwardly to an outer periphery of the pipe storage means for admitting one section of drill pipe into the central support tube.

3. A pipe carousel according to claim 2 in which the pipe storage means comprises support means defining at least one annular support slot concentric with said tube and having an access opening along the radial slot.

4. A pipe carousel according to claim 2 in which the pipe storage means comprises support means defining multiple linear support slots extending generally radially outwardly from an inner end adjacent said tube to an access opening along the outer periphery of the storage means.

5. A pipe carousel according to claim 2 in which the pipe storage means comprises support means defining support slots for supporting sections of drill pipe and flange means in each support slot for engaging flat gripping surfaces in the sides of said sections.

6. A pipe carousel according to claim 2 including a bottom rack plate mounted on the central tube for rotation therewith, the bottom plate including:

a radial entry slot aligned with the opening in the tube and extending radially outwardly to the periphery of the bottom plate, and bottom pipe support means for cupping the lower ends of multiple sections of drill pipe stored in the pipe storage means.

7. A pipe carousel according to claim 1 in which the engaging means comprises a pair of horizontal flanges secured inside the central support tube on opposite sides of said opening to grip opposite sides of the pipe section, the opposite sides of the section including indented portions defining flattened parallel gripping surfaces, the flanges including flat, inwardly-opposed, parallel faces spaced apart to just fit the gripping surfaces of the section therebetween.

8. A pipe carousel according to claim 1 in which:

the rotating means includes a driven gear mounted on the central support tube, the gear having a radial slot aligned with the opening in the tube and extending radially outwardly to the periphery of the gear; and the drive means includes a reversible drive motor and a drive gear means drivably connected to the drive motor for driving the driven gear;

the drive gear means being arranged to bridge the slot in the driven gear during rotation.

9. A pipe carousel according to claim 8 in which the reversible drive motor is a high torque hydraulic motor means for applying high torque at low rotational speed, to unscrew jammed pipe threads.

10. A pipe carousel according to claim 8 in which the drive gear means comprises a primary drive gear mounted for rotation on an output shaft of the drive motor and a pair of secondary drive gears connected in parallel between the primary drive gear and the driven gear, the secondary drive gears being spaced apart around the driven gear so that one of the secondary drive gears is meshed with driven gear when the slot in the driven gear rotates past the other secondary drive gear.

11. A well-drilling pipe carousel comprising:

a circular pipe rack means rotatable about a vertical axis for storing multiple sections of drill pipe in proximity to a drill string;

central support means for supporting a top section of drill pipe in the drill string in the center of the pipe rack means for rotation therewith about said axis;

rotating means for rotating the pipe rack means and central support means about said axis;

entry means in the pipe rack means and central support means for admitting said top section of drill pipe along a lateral path past said multiple sections into said central support means; and moving means for moving said pipe rack means and central support means along a lateral path to a position concentric with said drill string so as to envelop said top section of drill pipe and position it in the central support means for unscrewing from the drill string.

12. A method for tripping a drill string supported by a top head drive, comprising:

pulling the drill string up to expose a top section of drill pipe;

securing the drill string below said top section against dropping and rotating;

moving a rotatable pipe rack means laterally toward the drill string to position said top section concentrically along the rotational axis of the rack means;

securing said top section in the rack means along said axis against rotation relative to the rack means;

rotating the rack means to unscrew said top section from the drill string;

moving the pipe rack means laterally to a position nonconcentric with the drill string, the top section of drill pipe remaining supported by the top head drive;

rotating the rack means to position the top drill pipe section in a storage location away from the rotational axis of the rack;

securing the top section against rotation in said storage location; and operating the top head drive to unscrew its drill stem from the top section of drill pipe.

13. A method for tripping a drill string supported by a top head drive, comprising:

pulling the drill string up to expose a top section of drill pipe;

securing the drill string below said top section against dropping and rotating;

moving a rotatable pipe rack means laterally toward the drill string to position said top section concentrically along the rotational axis of the rack means;

securing said top section in the rack means along said axis against rotation relative to the rack means;

rotating the rack means to unscrew said top section from the drill string;

moving the pipe rack means laterally to a position nonconcentric with the drill string, the top section of drill pipe remaining supported by the top head drive;

rotating the rack means to position the top pipe section adjacent a storage location away from the rotational axis of the rack, moving the rack means toward the drill string to position the top drill pipe section in the storage location, and securing the top section against rotation in said storage location; and operating the top head drive to unscrew its drill stem from the top section of drill pipe.

* * * * *